US005630482A

United States Patent [19]

Schwörer

[11] Patent Number: 5,630,482

[45] Date of Patent: May 20, 1997

[54] CLIMBING DEVICE, IN PARTICULAR FOR A CLIMBING SCAFFOLD

[75] Inventor: Artur Schwörer, Senden, Germany

[73] Assignee: Peri GmbH, Weissenhorn, Germany

[21] Appl. No.: 500,983

[22] PCT Filed: Jan. 22, 1994

[86] PCT No.: PCT/DE94/00062

§ 371 Date: Jul. 24, 1995

§ 102(e) Date: Jul. 24, 1995

[87] PCT Pub. No.: WO94/17265

PCT Pub. Date: Aug. 4, 1994

[30] Foreign Application Priority Data

Jan. 27, 1993 [DE] Germany ..... 43 02 197.2

[51] Int. Cl.[6] ..... E04G 11/28

[52] U.S. Cl. ..... 182/82; 182/141; 425/65

[58] Field of Search ..... 182/141, 82, 36, 182/37; 425/65

[56] References Cited

U.S. PATENT DOCUMENTS 4,040,774 8/1977 Scheller ..... 425/65
4,147,483 4/1979 Rovera et al. .

FOREIGN PATENT DOCUMENTS 7380687 12/1987 Australia ..... E04G 11/28
0373617A2 6/1990 European Pat. Off. .
2021672 12/1979 United Kingdom ..... E04G 11/24
2098654 11/1982 United Kingdom ..... E04G 11/28

*Primary Examiner*—Alvin C. Chin-Shue
*Attorney, Agent, or Firm*—Flynn, Thiel, Boutell & Tanis P.C.

[57] ABSTRACT

A self-climbing device, in particular for a climbing scaffolding, with at least one linear drive which produces a relative motion between at least one moving console and at least one mounting rail running in the displacement direction, in particular when the linear drive alternately displaces a scaffolding section and, following attachment of same to the wall and loosening of the attachment of the mounting rail, the mounting rail by a working section, is characterized in that the connection between the linear drive (13) and the mounting rail (6) is established by climbing heads (14, 15) arranged at separations from each other which exhibit at least one pivotable locking member (24) functioning in the manner of a detent pawl and locking cams (29) are provided for on the mounting rail (6) along the path of the locking member (24) during relative motion between the mounting rail and the climbing head which cooperate with same and the locking member (24) is lifted over the locking cams (29) by relative motion in one direction while, in the other direction of motion, abutting the locking cam (29) so that one climbing head form-fittingly connects to the mounting rail (6) to block this relative motion, whereas, on the other climbing head, a relative motion which overcomes the locking cams takes place. The drive is simple and safe.

12 Claims, 5 Drawing Sheets

CLIMBING DEVICE, IN PARTICULAR FOR A CLIMBING SCAFFOLD

BACKGROUND OF THE INVENTION

The invention concerns a self-climbing device having at least one linear drive which produces a relative motion between at least one moving console and at least one mounting rail running in the direction of displacement, whereby the connection between the linear drive and the mounting rail is effected by means of climbing heads arranged at separations from each other which exhibit at least one pivotable locking member, and with locking cams on the mounting rail in the path of the locking member during relative motion between the mounting rail and the climbing head which cooperate with the locking member, whereby the locking member is lifted during relative motion in one direction over the locking cams and, in the other motional direction, abuts on the locking cams so that one climbing head is form-fittingly connected to the mounting rail to block this relative motion whereas, on the other climbing head, a relative motion overcoming the locking cams takes place.

The scaffold section, during climbing, has no direct connection to the ground and no crane is necessary if a linear drive, for example a hydraulic drive, is provided for on the scaffolding which, in a working step, lifts the scaffold section on the mounting rails, and in another working step, lifts the mounting rails relative to the scaffolding section.

In self-climbing devices which are known in the art as, for example, described in U.S. Pat. No. 4,147,483, the connection between the linear drive and the mounting rail is effected by pivotable pawls arranged at separations from each other which exhibit two separated support teeth. The support teeth are lifted over the locking cam during relative motion between the pawl and the mounting rail in one motional direction, whereas they abut on the locking cams in the other motional direction so that the one pawl is form-fittingly connected in a locking fashion to the mounting rail following this relative motion whereas the other pawl carries out a relative motion which overcomes the locking cam.

With this type of relative motion the pawl can improperly jam or may not pass by the locking cam in the desired manner. This leads to a jamming of the individual construction elements or in fact to the lack of engagement of the pawl at the locking cam so that the climbing device is not sufficiently safe.

It is the underlying purpose of the invention to simplify and render more secure the drive mechanism in this type of self-climbing device.

SUMMARY OF THE INVENTION

This purpose is achieved in accordance with the invention in that the climbing heads exhibit a pivotable control member and a pivotable locking member and a control curve is provided for on the mounting rail in the path of the control member during relative motion between the mounting rail and the climbing head and the control member and the locking member are coupled to each other in such a fashion that the locking member is rotated by the control curve via the control member in the other motional direction in such a fashion that the locking member abuts on the locking cam.

The device in accordance with the invention has the advantage that it functions without electronic or electrical components and switches which could cause failures and in particular, a locking member drive is provided for which is adapted to the requirements and loads and which is not susceptible to breakdown to thereby guarantee as large a degree of safety as possible.

Since, the locking member via the coupling is lifted during relative motion in one direction over the locking cams by the control curve while abutting in the other motional direction on the locking cam, the locking member is form-fittingly held in engagement so that no spring is necessary therefor which could likewise cause failures.

The invention is suitable, for example, for a self-climbing device with which the rails extend over the entire height of the complete motion, for example for elevators or the like. On the other hand if the device is to be utilized for a climbing scaffold with which mounting rails and scaffold portions are alternately raised, the height of the mounting rail assumes a value somewhat larger than twice the height of a working section, whereby the device in accordance with the invention is completely functional not only in one direction of motion but also in the opposite direction of motion. In an embodiment of the invention the climbing heads thereby exhibit effective locking members in two opposing motional directions.

The embodiment in accordance with the invention can also be further configured such that the control member and the locking member can be coupled to each other in at least two different angular positions, whereby the one angular position is correlated to the lifting of a moving console and the other angular position to the lifting of the mounting rail.

In this fashion one guarantees that, for each relative motion, the locking member engages into the path of the locking cams where it is form-fittingly held by means of the engaging motion which is transferred by the control curve via the control member to the locking member. In this fashion, the moving console can, for example, not only be sectionswise raised on the mounting rails, but also be sectionwise lowered in the same fashion.

The coupling between the locking member and the control member can be configured in an arbitrary fashion.

In an embodiment of the invention the locking member and the control member are arranged in a rotatable fashion on a common axis. This facilitates a particularly simple coupling between these two members, for example by means of holes through both members, which are flush in one coupling as well as in another coupling position and through which a bolt can be inserted so that the coupling functions integrally.

In an embodiment of the invention the locking member and the control member are configured as plates and arranged next to each other.

This embodiment of the invention can be further configured in such a fashion that one of the two members exhibits a circular segment shaped edge and the coupling exhibits a bolt attached to one of the two members which is movable in a radial direction and which cooperates with catches arranged on the edge of the other member.

The control member and the control curve can be configured in a plurality of fashions, and it is only important that the control member and the control curve transfer in a form-fitting fashion a precise motion from the control curve to the locking member.

In an embodiment of the invention the locking member exhibits two arms extending radially with respect to the pivot axis with, in one coupling position, the one arm and, in the other coupling position, the other arm projecting into the path of the locking cams.

In an embodiment of the invention the control member also exhibits two arms extending radially with respect to the pivot axis one of which cooperates with the control curve.

The control curve can be configured in an arbitrary fashion, for example from a continuous curve line. However, in one embodiment of the invention, the control curve exhibits individual curve sections which are arranged distributed along the length of the mounting rail and which exhibit a section running parallel to the direction of motion at the position corresponding to the point of deepest engagement of the locking member into the path of the locking cams.

This embodiment can be further improved such that the length of this section of the curved pieces running parallel to the direction of motion corresponds approximately to the separation between the points with which the arms of the control member lie at an angular position on a curve section so that, in one angular position both arms of the control member lie on this straight section.

The climbing head in accordance with the invention can also be utilized with scaffolds with which one section of a scaffold contains the working platform raised by means of a self-climbing device arranged at its middle as well as with scaffolds with which the movable scaffolding section is raised by two or more climbing devices which function synchronously. The climbing heads can also be provided in other lifting devices, for example in freight elevators with which the mounting rail extends not only along two working positions arranged above another rather along the complete height to be travelled by a moving console, for example, for freight elevators in multipil-story warehouses. The climbing heads in accordance with the invention can also be provided for with diagonally running elevators or the like where a compulsory control by means of a control curve with alternatingly engaging locking member is advantageous in a lifting device.

Further features of the invention result from the following description of embodiments of the invention in combination with the claims and the drawing. The individual features can be used individually or collectively in embodiments of the invention.

An embodiment of the invention is represented in the drawing.

DETAILED DESCRIPTION

Figure 1:
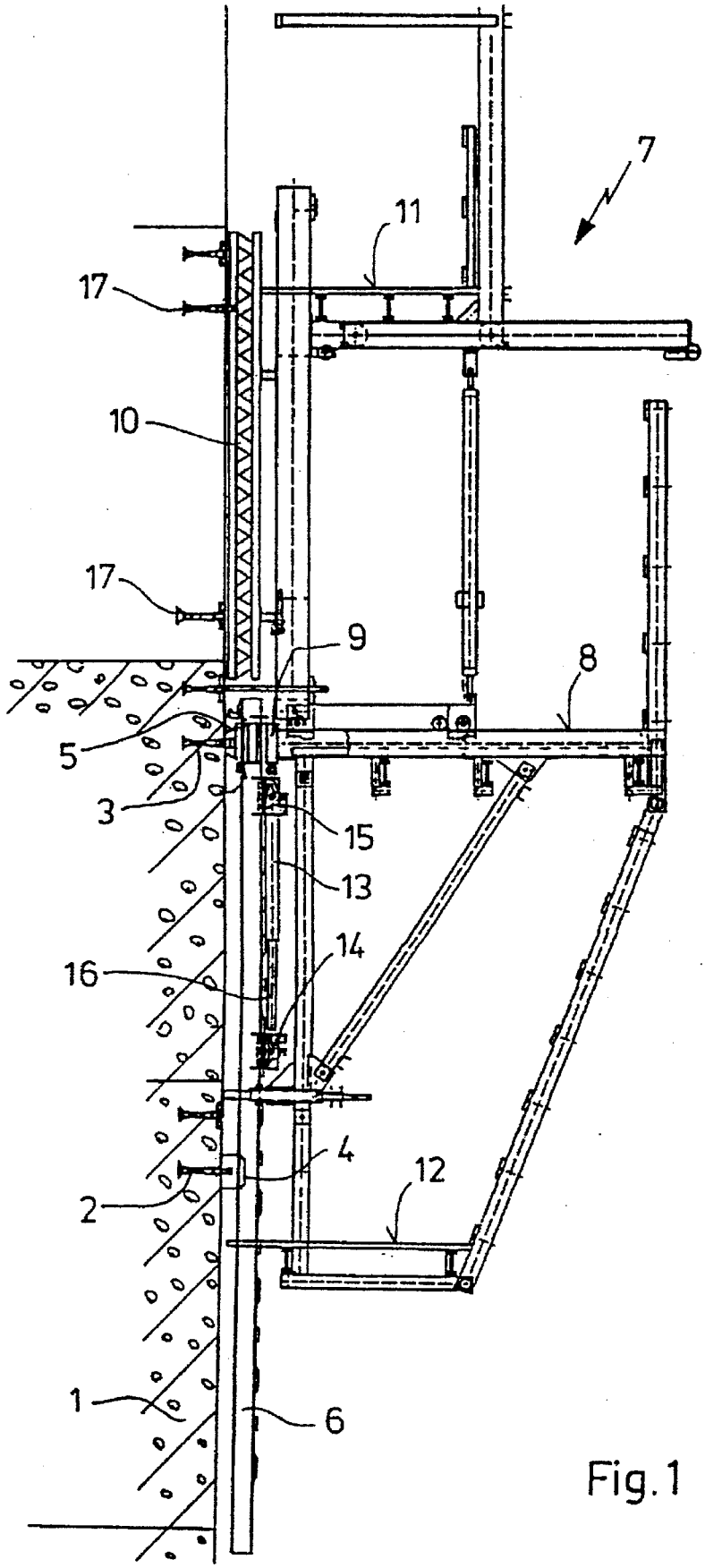
FIG. 1 shows a view of a climbing scaffold.

In the embodiment shown in the drawing a plurality of anchoring bolts are imbedded in the poured concrete section of a building wall 1. Scaffolding shoes 4 and 5 are attached to the anchoring bolts 2 and 3 which, in turn, are arranged above each other at a separation corresponding to the height of a concrete section and a mounting rail 6 is guided in the scaffold shoes whose height is adjustable, the mounting rails exhibiting an I-shaped cross-section. The scaffold shoe 4 only guides the rail 6, whereby the scaffold shoe 5 also exhibits attachment devices with which the climbing scaffold, designated in its totality as 7, can be attached to wall 1. The climbing scaffold 7 exhibits a working platform 8 which has a moving console 9 on the end facing the wall in which the mounting rail 6 is guided and which can be suspended and secured in the attachment device of the scaffold shoe 5. One or more mold elements 10 having the height of a single story are guided at right angles to the wall 1 on the working platform 8 in a displaceable fashion.

FIG. 1 shows the mold element 10 in a position in which the next concrete section can be poured (the usual reenforcement is not shown). A leading platform 11 is shown in the climbing scaffold above the working platform 8 and below the working platform 8 is a trailing platform 12. In the embodiment shown, the climbing of the climbing scaffold 9 into the next concrete section transpires in a plurality of steps, since a linear drive 13 provided for the lifting of the climbing scaffold 7 is realized in the embodiment shown by means of a hydraulic cylinder whose stroke is substantially smaller than the height of a story. A spindle drive, chain or a belt drives, rack drives or other devices can, however, be provided for as linear drives which facilitate a substantially larger stroke, by way of example a stroke which lifts the climbing scaffold 7 by the full height of a concrete section, for example, by the height of a single story in a single working step.

A climbing head 14 is located on the lower end of the hydraulic drive 13 on its piston rod 16, which cooperates with the mounting rail 6. A climbing head 15 is located on the upper end of the hydraulic drive 13 which likewise cooperates with the mounting rail 6 and to which the moving console 9 is also attached.

As soon, in the position represented in FIG. 1, as the section of the concrete wall adjacent to the mold element 10 is poured and completed, the mold element 10 is removed after the concrete has set. Anchoring bolts 17 have already been imbedded in this freshly poured concrete section which can serve for attachment of the scaffold shoes.

Figure 2:
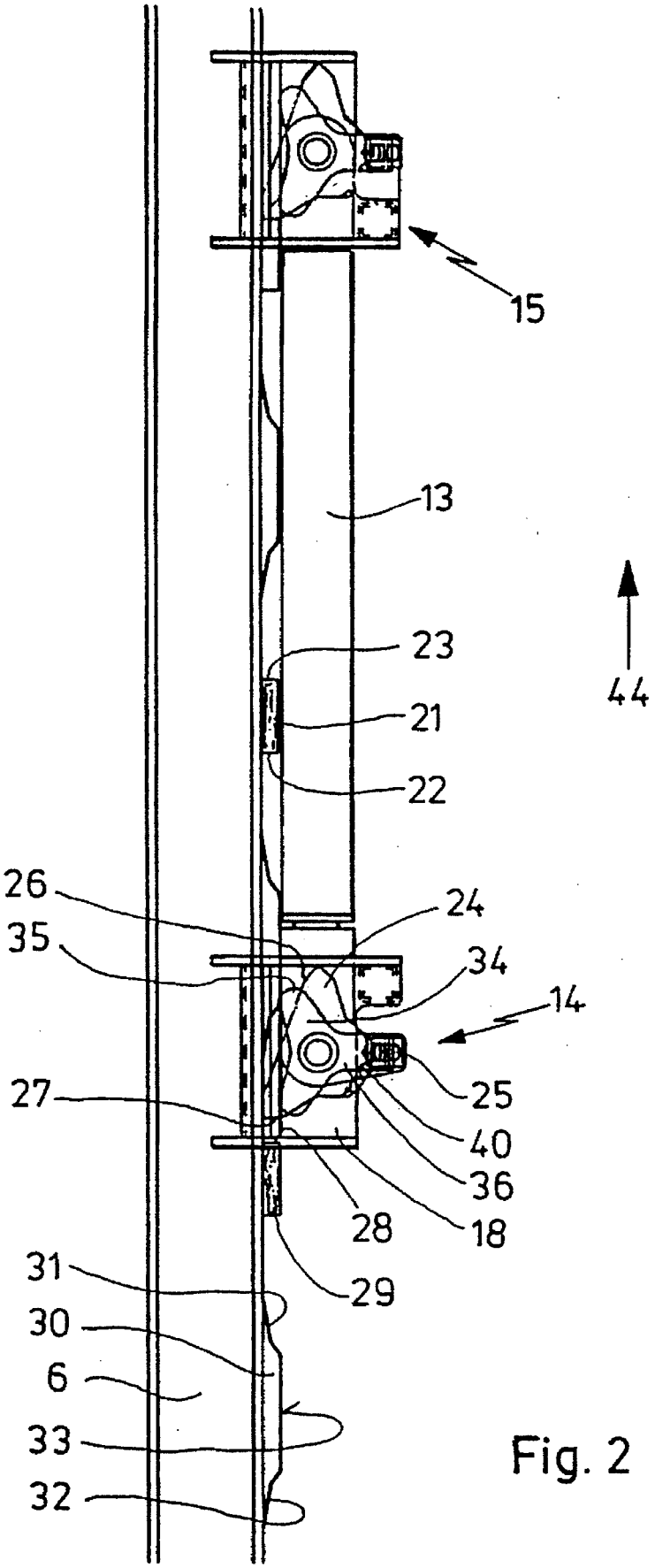
FIG. 2 shows a section of FIG. 1 in enlarged scale.
Figure 3:
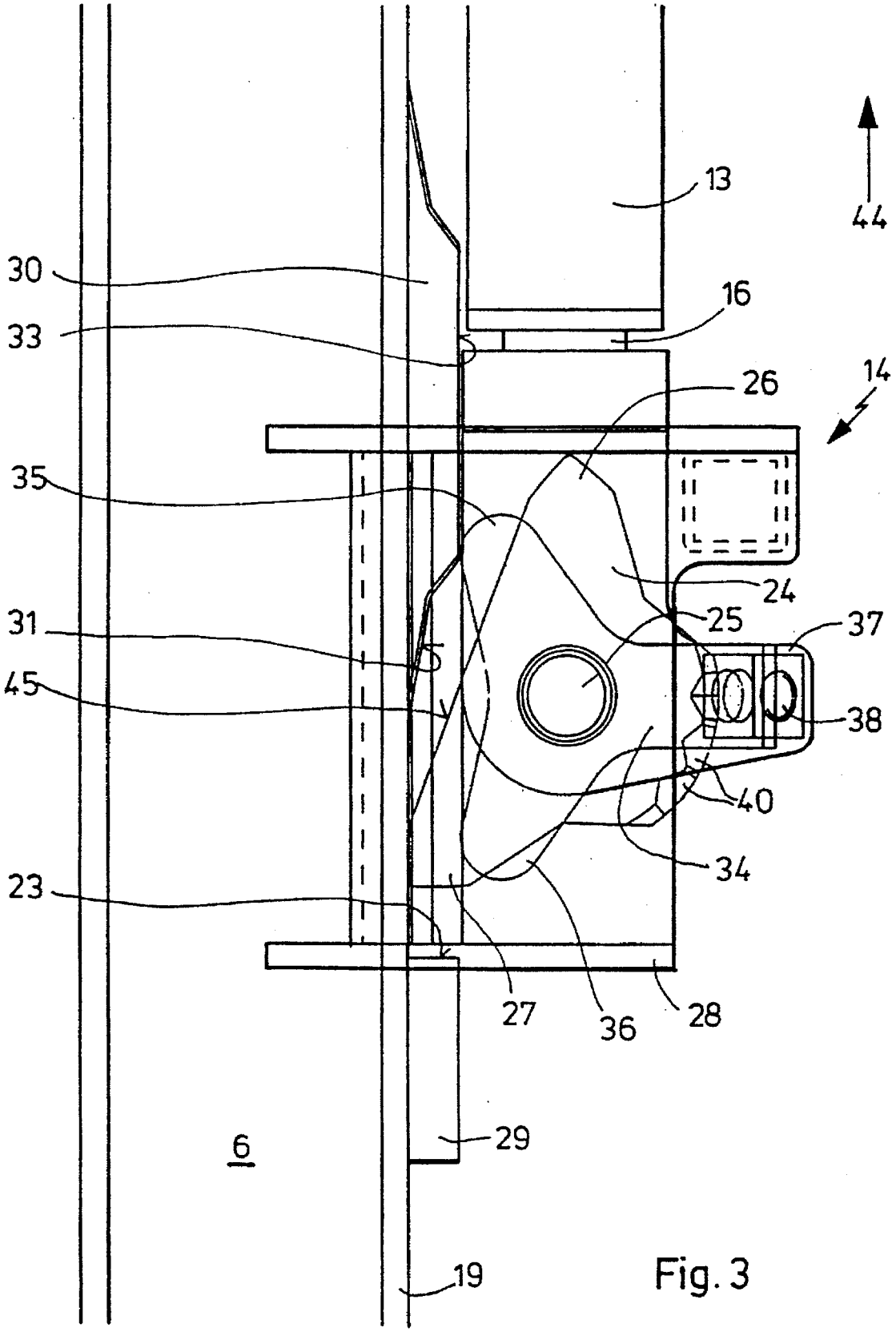
FIG. 3 shows a cross-section of an embodiment of a climbing head in more greatly enlarged scale.
Figure 4:
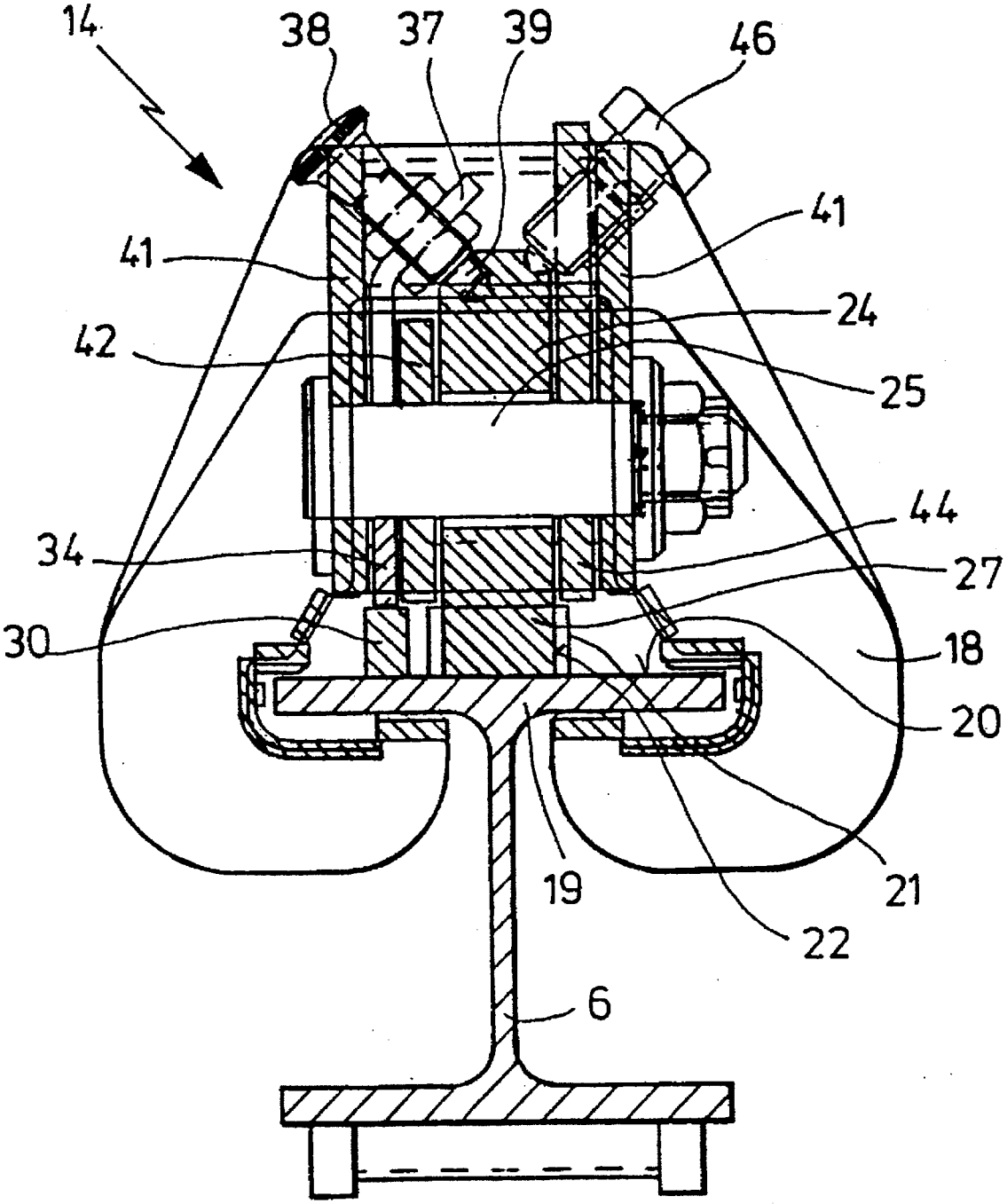
FIG. 4 shows a cut through a lower and FIG. 5. shows a cut through an upper climbing head.
Figure 5:
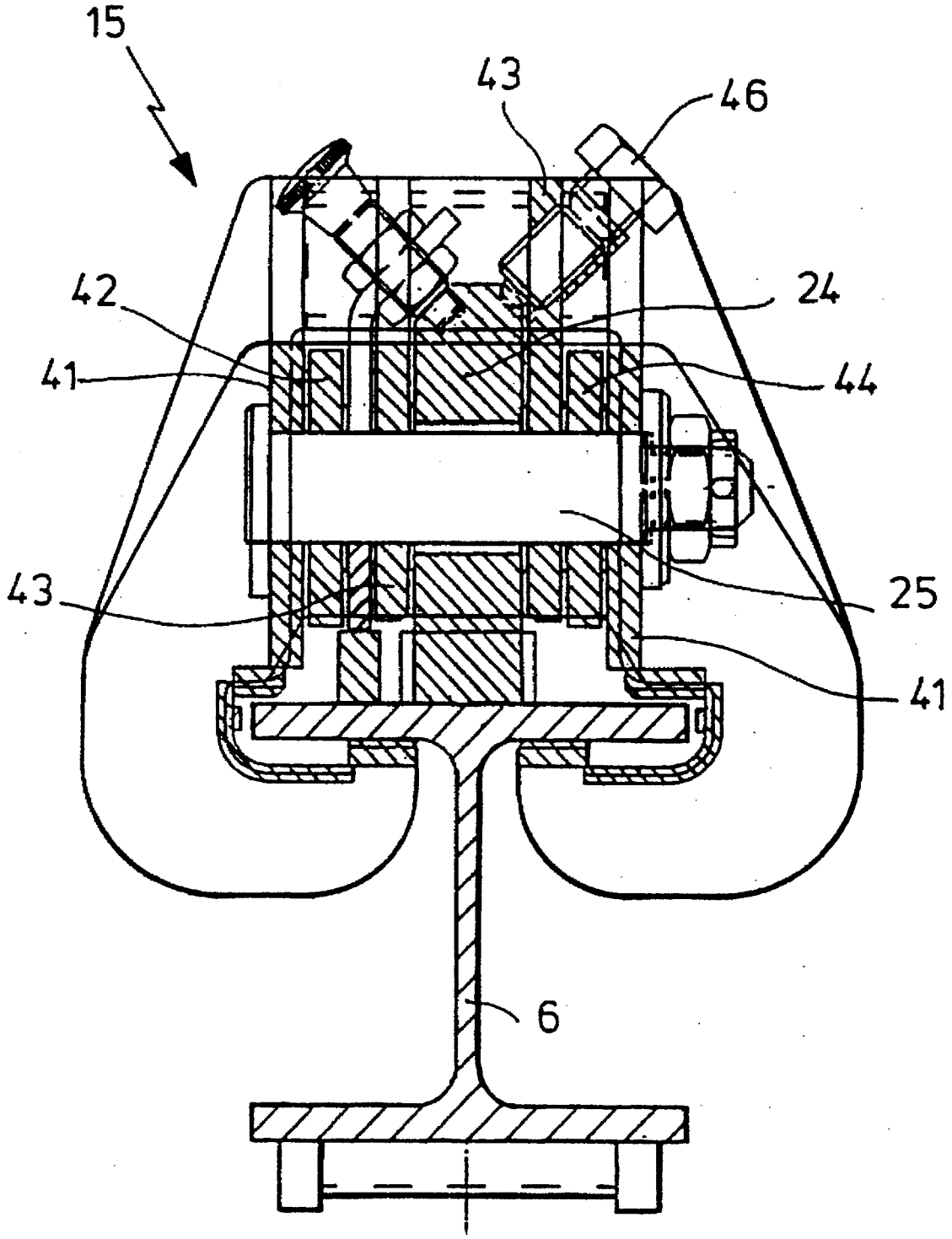

The climbing heads 14 and 15 are more precisely described in FIGS. 3–5. The climbing head exhibits a housing 18 which surroundingly engages one leg 19 of the I-profile of the mounting rail 6. Locking cams 21, 29 are arranged in the longitudinal mid-plane of the rail 6 at separations from another on the front surface 20 of the I-profile facing away from the wall 1, whose side surfaces pointing in the direction of motion extend at right angles to the front surface 20. A locking member 24 is located in the path of these locking cams 21, 29 which is pivotably supported about a bolt 25 in the housing 18 and which exhibits two radial arms 26 and 27 each of which seats, depending on the rotational position of the locking member 24 on the bolt 25 during relative motion between the mounting rail 6 and the climbing head 14, on the front surface 22 of the upper locking cam 21 or, as shown in FIG. 2 when moving the upper climbing head in the upward direction, on the front surface 28 of the next lower locking cam 29.

Curved members 30 are located at separations from another along the length of the mounting rail 6 at a separation sidewardly adjacent to the locking cams 21 and 28 whose side surfaces pointing in the direction of relative motion exhibit rise curves 31 and 32. The surfaces 33 facing away from the mounting rail 6 run parallel to front surface 20. The curve members 30 and the locking cams 21, 29 are arranged on the mounting rail displaced at heights relative to each other.

The climbing head 14 exhibits a control member 34 which is pivotably supported about the bolt 25 in the path of this curve member 30, which likewise exhibits two radially extended arms 35 and 36. In a middle position, as shown in FIGS. 2 and 3, the two arms 35 and 36 slide over the surface 33. The surface 33 is sufficiently long that both arms 35 and 36 can simultaneously seat on the surface 33.

The locking member 24 and the control member 34 are plate-shaped and are supported in a rotatable fashion adjacent to and independent of each other on the bolt 25. A coupling bolt 38 is mounted in a longitudinally displaceable fashion on a part of the control member 34 facing away from the mounting rail 6 in an extension 37 whose inner end 39 facing the locking member 24 cooperates with catches 40 which are carved out of the periphery of the locking member 24. The end 39 of the coupling bolt 38 is pressed against the edge of the locking member 24 by means of a pressure spring which is not shown. Fork ends 42 and 44 engaging at bolt 25 are part of an attachment component with which the piston rod 16 is attached to the lower climbing head 14 or with which the moving console 9 of the working platform 8 or the hydraulic cylinder attached thereto is attached to the upper climbing head 15.

The upper climbing head 15 (FIG. 5) is distinguished from the lower climbing head 14 only in that the bolt 25 in the climbing head 14 is solely supported in the two outer side housing walls 41 whereas in the upper climbing head 15, two additional intermediate housing walls 43 are provided for between the outer housing walls 41 and the locking member 24 which additionally direct the scaffolding load transferred to the moving console 9 onto the locking member 24 and the mounting rails 6 or the scaffold shoes 5.

A catch bolt 46 is mounted in the housing 18 in a longitudinally displaceable fashion. It exhibits, at its front end, a spring loaded ball which snappingly engages depressions on the edge of the locking member 24 to hold the control member and locking member, which are rigidly connected to each other by means of the coupling bolt 38, with a low amount of force in a particular rotational position assumed by these members, for example, when travelling over a locking cam 29 and a curved member 30.

In the event that the climbing scaffold is to be lifted out of the position shown in FIG. 1, the attachment of the transport rails 6 in the scaffold shoes 4 and 5 is initially released, whereby the moving console 9 connected to the working platform 8 remains secured in the scaffold shoe 5. If the hydraulic cylinder 13 is then activated, the climbing head 14 which is attached at the lower end of the piston rod 16 and which engages the mounting rail 6 is upwardly displaced together with same to such an extent as allowed by the stroke of the hydraulic cylinder 13. The mounting rail 6 thereby slides through the climbing head 15 which allows this motion of the mounting rail 6, whereas the arm 26 of the locking member 24 engages into the lower climbing head 14 behind a locking cam to thereby urge the mounting rail upward. The mounting rails 6 are then once more secured in the scaffold shoes 4 and 5 and the piston rod 16 is activated once more whereby the arm 26 of the locking member 24 passes over locking cams 21 located along its path and again engages beneath a locking cam in the lower end position of the piston rod 16. The mounting rail 6 is thereby again released from the wall and once more raised by a stroke length during the next pulling-in of the piston rod 16 into the hydraulic cylinder 13. This process is repeated until the mounting rail 16 has been raised by one concrete section to thereby be attached in additional attachment components upwardly arranged in the wall. With a 3 m high concrete section and a stroke of the hydraulic cylinder of 60 cm this processing stage is repeated 5 times to lift the mounting rail. Then, in the representation choosen in FIG. 1, the mounting rail 6 seats with its lower end in the vicinity of the scaffold shoe 4 and projects with its upper end sufficiently far in the upper direction above the scaffold shoe 5 that the climbing scaffold 7 can be displaced by one concrete section along the support rails 6 attached to the wall.

The climbing heads 14 and 15 are then switched over so that the climbing head 14 is supported on one of the locking cams 21, 29 of the then secured mounting rail 6. The attachment of the moving console 9 in the scaffold shoe 5 is then released and the hydraulic cylinder 13 is driven out whereby the upper climbing head 15 which then slides along the mounting rail 6 in the upper direction, urges the moving console 9 and thereby the hydraulic cylinder 13 in the upper direction. When the piston rod 16 is in the outward position, the moving console 9 and thereby the climbing scaffold 7 are attached to the wall and the piston rod 16 is again introduced into the cylinder 13 whereby the arm 27 of the locking member 24 engaging, after the switching over of the climbing heads, into the mounting rail 16 and thereby into the path of the locking cams 21, 29, glides over the locking cams 21, 29 due to its smooth lower surface 45.

In the event that the piston rod 16 is completely driven-in, the attachment of the moving console 9 is once more released whereby the scaffold is supported in the climbing heads 14 and 15 by means of the arms 27 of the locking member 24 supported at the locking cams. The piston rod 16 is then driven-out once more and the moving console 9, the scaffolding and the hydraulic cylinder 13 are thereby driven upwardly by one stroke length, whereby the arm 27 of the locking member 24 of the upper climbing head 15 engaging into the path of the locking cams 21, 29 slides over the locking cams with the flat lower surface 45 of the locking member 24.

This process is continued until the working platform 8 has been lifted by one concrete section after which, following reenforcement work and other preparatory work, the molding element 10 is once more positioned into the molding plane and attached there so that concrete can be poured in this section.

Individual working steps are described more closely below.

In the position of the locking member 24 and control member 25 represented in FIG. 2, which is determined by the engagement of the coupling bolt 38 into the uppermost catch 40 in FIG. 5 of the locking member 24, the arm 35 of the control member 34 still lies on the upper surface 33 of the curved member 30 and the arm 27 of the locking member 24 is urged by the arm 35 to be adjacent to the front surface 20 of the leg 19 of the mounting rail 6. In this position the mounting rail 6 is secured in the scaffold shoes 4 and 5, whereas the attachment of the moving console 9 at the scaffold shoe 5 is released so that the moving console 9 can be displaced along the mounting rails 6. In this representation according to FIG. 2 one assumes that the mounting rail 6 has already been transported upwardly in a preceding working step above the position shown in FIG. 1. If the hydraulic cylinder 13 is than activated, the climbing head 14 moves by a small amount downwardly from the position represented in FIGS. 2 and 5 until the arm 27 of the locking member 24 seats on the upper outer surface 23 of the locking cam 29 to thereby support the lower climbing head 14. Subsequently, due to the fact that the mounting rail 6 is rigidly connected to the wall, the hydraulic cylinder 13 moves upwardly in the direction of the arrow 44, whereby it displaces the upper climbing head 15 and the moving console connected thereto along the mounting rail 6 in the upward direction. The position of the locking member 24 and the control member 34 is the same in climbing head 15 as in climbing head 14 since, also for climbing head 15, the coupling bolt 38 engages into the same catch 40 of the locking member 24. Although, during this upward motion, the flat lower surface 45 of the locking member 24 seats diagonally on the next higher locking cam, the upper climbing head 15 can nevertheless travel over this locking cam since, as one can see in FIG. 2 with respect to the locking cam 21, the locking member 24 is somewhat rotated in a counterclockwise direction until the arm 27 can slide over the upper surface of the locking cam 21. The control member 34 does not cause interference during this rotating motion since its arm 35 has already left the relevant curve member 30 due to the vertical displacement between the locking cam and the curve member so that the control member 34 can exercise this rotating motion. During this lifting of the scaffolding 7 same is supported on the lower climbing head 14 and, via the arm 27 adjacent to the locking cam 29, on the mounting rail 6 which, as mentioned, is secured during this motion in the scaffold shoes 4 and 5 and thereby in the wall 1.

When this motion is completed the moving console 9 is suspended and secured at the next higher scaffold shoe. The piston rod 16 is then moved-into the hydraulic cylinder 13 with same raised by the climbing head via the preceding working step. In this return stroke the lower climbing head 14 passes over the locking cams in the same manner as had previously the upper climbing head 15. The moving console is then again released from the wall 1 so that, when driving out the piston rod the moving console, supported on the lower climbing head 14 is again raised by a stroke length. When the scaffolding has reached its upper end position following a plurality of working steps and is attached to the wall, the locking member 24 is rotated relative to the control plate 35 by loosening of the coupling bolt 38 in such a manner that the coupling bolt 38 then engages into the lowermost catch 40 of the locking member 24 in FIG. 5. In this fashion, in the position represented in FIG. 3, the arm 36 of the control member 34 is moved downwardly in a counterclockwise direction so that same, when abutting on the rise surface 31 of the next curve member 30, pivots the mutually coupled plates of the locking member 24 and locking member 34 in a counterclockwise direction so that the arm 26 is guided on the front surface 20 of the mounting rail 6 and, when further lifting the lower climbing head 14, seats on the front surface 22 of the locking cam and, by further raising of the climbing head 14, carries the mounting rail 6 upwardly. The upper end of the hydraulic cylinder 13 is thereby above the upper climbing head 15 and the moving console 9 is rigidly connected to the wall.

When the piston rod 16 is driven-in the mounting rails 6 are, in this new position, once more secured in corresponding scaffold shoes and the piston rod 16 is driven-out in a return stroke (e.g. without load). The above mentioned process for lifting the mounting rails is then repeated.

In the event that the scaffolding is to be lifted again, the couplings in the climbing heads are once more released and locking member 24 and control member 24 are pivoted with respect to each other in such a fashion that the coupling bolt 38 once more engages into the uppermost catch 40 of FIG. 3 so that both members again assume the position relative to each other shown in FIG. 3. The moving console 9 is then released from the scaffold shoe in which it had been attached and a new working sequence is introduced by activating a cylinder 13 with which the lower climbing head once more is supported on the mounting rail which is now attached to the wall to upwardly displace the upper climbing head 15 together with the scaffolding 7.

When the mounting rail 6 and then the scaffolding 7 are to be lowered, the coupling in the climbing heads, with climbing head 15 attached to the wall, is adjusted in such a fashion that the coupling bolt 38 engages into the lowermost catch to thereby pivot the arm 26 of the locking member 24 in a counterclockwise direction so that same engages at a lower outer surface 22 as soon as the mounting rail 6 is released from its scaffold shoe for downward motion. The mounting rail 6 then moves, when positioning-out the piston rod 16, along with the lower climbing head 14 in a downward direction. The mounting rail 6 is, for its part, then attached to the wall and, following a return stroke, this working step is repeated. If the mounting rail 6 is in its lower end position, the coupling in the climbing heads is switched over again, the upper climbing head 15 is released from the wall, and the piston rod 16 is driven-in once more, whereby the scaffolding 7 connected to the upper climbing head 15 is lowered by the stroke of the hydraulic cylinder 13.

Clearly, following the first lifting step one can also attach the moving console 9 to an anchoring bolt in the wall. However, it would then be necessary, with a stroke of 60 cm, to provide an anchoring bolt in the wall at intervals of 60 centimeters, something which is avoided when, during these intermediate steps, the moving console 9 is only attached to the mounting rail 6. Anchoring bolts are thereby only required at separations corresponding to the height of a story in the scaffolding shoes of which the climbing scaffolding 7 is suspended in its raised final position and to which the transport rail 6 is attached when same is guided into the raised position which, in the current example, likewise transpires in individual steps of the size of the stroke of the hydraulic cylinder 13.

If a plurality of such raising mechanisms are engaged on a single scaffolding section, the hydraulic cylinders 13 are connected to each other by an apparatus known in the art which guarantees a precise simultaneous travel of the hydraulic cylinders 13.

Clearly, the invention can also be realized in embodiments with which a linear drive is utilized whose stroke is as large as a concrete section. The steps between switching over of the couplings in the climbing heads are thereby eliminated.

I claim:

1. A self-climbing device comprising:

a moving console;

a mounting rail extending in a direction of displacement;

a linear device means to produce a relative displacement between the moving console and the mounting rail;

a first and a second climbing head connected between the linear drive means and the mounting rail, the first and the second climbing head being separated from each other, each of the first and the second climbing heads having a pivotable locking member and a pivotable control member coupled to the pivotable locking member;

locking cam means integral with the mounting rail and cooperating with the locking member during relative displacement between the mounting rail and the climbing head; and a control curve means integral with the mounting rail and cooperating with the control member during relative displacement between the mounting rail and the climbing head, wherein the control curve means rotates the locking member via the control member to abut the locking member on the locking cam means during relative motion in a first direction, the locking member being lifted over the locking cam means during relative motion in a second direction.

2. The device of claim 1, wherein the locking member is adapted to operate in two opposing displacement directions.

3. The device of claim 1, wherein the control member and the locking member are adapted for coupling at a first and a second angular position, the first angular position for displacement of the moving console and the second angular position for displacement of the mounting rail.

4. The device of claim 1, wherein the locking member and the control member are adapted to rotate about a common axis.

5. The device of claim 4, wherein the locking member and the control member each comprises a plate.

6. The device of claim 4, wherein one of the locking member and the control member has a circular shaped edge section and further comprising spring loaded bolt means attached to the locking member and cooperating with catches in the control member.

7. The device of claim 4, wherein one of the locking member and the control member has a circular shaped edge section and further comprising spring loaded bolt means attached to the control member and cooperating with catches in the locking member.

8. The device of claim 3, wherein the locking member comprises a first and a second arm extending radially from a pivot axis, the first arm projecting into a path of the locking cam means in the first angular position and the second arm projecting into the path of the locking cam means in the second angular position.

9. The device of claim 1, wherein the control member comprises a forward and a backward arm extending radially from a pivot axis, the forward arm cooperating with the control curve means in a forward displacement direction.

10. The device of claim 1, wherein the control curve means comprises curve members distributed along the mounting rail, the curve members having an edge facing away from the mounting rail and extending parallel to the direction of displacement.

11. The device of claim 10, wherein the control member comprises a forward and a backward arm and the edge has a length corresponding to a separation between points at which the forward and backward arm lie on a curve member.

12. The device of claim 1, wherein the first and the second climbing heads each comprise a coupling bolt for coupling the locking member to the control member, a housing, and a catch bolt guided in a longitudinal displaceable fashion in the housing and adapted to hold the locking member and the control member at an angular position when passing over one of the locking cam and the control curve means.

* * * * *